US005771532A

United States Patent [19]

Munnoch

[11] Patent Number: 5,771,532

[45] Date of Patent: Jun. 30, 1998

[54] SUCTION SWEEPING MACHINE

[75] Inventor: Peter Alexander Clarence Munnoch, Alloa Clackmannanshire, Scotland

[73] Assignee: Applied Sweepers Limited, Stirlingshire, Scotland

[21] Appl. No.: 547,566

[22] Filed: Oct. 24, 1995

[51] Int. Cl.[6] ..... A47L 9/10

[52] U.S. Cl. ..... 15/352; 15/347

[58] Field of Search ..... 15/347, 352, 349

[56] References Cited

U.S. PATENT DOCUMENTS

| | | | |
|---|---|---|---|
| 2,388,280 | 11/1945 | Nuffer et al. | 15/347 X |
| 2,701,377 | 2/1955 | Luksch et al. | 15/349 X |
| 3,055,161 | 9/1962 | Hallstrom | 15/352 |
| 3,199,277 | 8/1965 | Moody | 15/347 X |
| 3,233,274 | 2/1966 | Kroll | 15/349 X |
| 3,461,479 | 8/1969 | Tierney | 15/352 X |
| 3,491,399 | 1/1970 | Dolan et al. | 15/352 X |
| 3,624,989 | 12/1971 | Gatheridge | 15/347 X |
| 3,813,725 | 6/1974 | Rinker | 15/347 X |
| 4,467,494 | 8/1984 | Jones | 15/352 X |
| 4,567,623 | 2/1986 | Walton | 15/352 X |
| 4,811,453 | 3/1989 | Lubraniecki | 15/352 X |
| 4,894,881 | 1/1990 | Palmer et al. | 15/352 X |

FOREIGN PATENT DOCUMENTS 2271728 4/1994 United Kingdom .

*Primary Examiner*—Chris K. Moore
*Attorney, Agent, or Firm*—Cumpston & Shaw

[57] ABSTRACT

A suction sweeping machine includes a filter arrangement for collecting debris from a fluid stream. The filter arrangement comprises an outlet leading into the filter arrangement, a container, preferably in the form of a plastic bag, for collecting debris and having an open upper end, and a porous tube which extends downwardly into the bag. The arrangement is such that a debris carrying fluid stream flowing from the outlet diffuses through the porous tube and out of the open end of the bag, while the debris remains within the bag. Preferably, the porous tube is flexible. In a preferred construction, the plastic bag is located in a compartment with an access door in a sidewall thereof, and a plurality of candle filters provide a secondary filter.

33 Claims, 10 Drawing Sheets

SUCTION SWEEPING MACHINE

This invention relates to a suction sweeping machine and more particularly to a filter arrangement for collecting debris from a fluid stream, in a suction sweeping machine.

One-man operated suction sweeping machines, such as the Green Machine (RTM) supplied by Applied Sweepers of Falkirk, Scotland, are becoming increasingly popular for use in the cleaning of pedestrian areas. Such machines include a suction inlet at ground level, through which debris is drawn and then collected in a large capacity bag or sack. In the Green Machine suction sweeping machine mentioned above, the larger debris is collected in a refuse sack or bag, which itself is contained within a 215 liter terylene outer filter bag, in which any fine dust or dirt not collected in the internal bag is trapped. The machine may be provided with water mist dust suppression which assists in containing dust particles within the internal bag.

It is among the objects of the present invention to provide a suction sweeping machine with a filter arrangement which is more convenient to use than known suction sweeping machines.

The present invention provides a suction sweeping machine of the type having a filter arrangement for collecting debris from a fluid stream, generated by a motor driven fan, the fluid stream emerging from an outlet; and passing through the filter arrangement into a container for collecting debris and having an opening in an upper portion thereof.

In accordance with one aspect of the invention, the filter arrangement comprises an open ended flexible porous tube extending from the outlet through the container opening and to the base of the container;

the arrangement being such that the debris-carrying fluid stream flowing from the outlet may diffuse through the porous member and out of the opening, while the debris remains within the container.

The fluid stream flowing from the outlet may carry papers, drinks cans, cigarette ends and the like. This bulky debris will collect in the container which may be periodically emptied or removed for disposal. Also, when used in a machine provided with water mist dust suppression, the "wet" dust and dirt will remain in the container and may thus be easily and cleanly removed from the machine. Similarly, when the suction sweeping machine passes over a puddle, the water drawn into the machine will be retained in the container and will not result in the machine leaving a trail of dirty water behind it as occurs with conventional machines. A special container is used in wet weather.

The container may be a rigid or semi-rigid box but is preferably in the form of a sack or bag. In the majority of applications a simple plastic "bin bag" or "plastics bin liner sack" will suffice, such that filled bags or sacks may be readily removed, sealed and disposed of, and a supply of replacement bags may be carried on the machine. The ability to use such bags also reduces the running costs of the machine; these bags are relatively inexpensive and available from a wide variety of sources. The bag may be located within a bucket or box which provides protection for the bag and improves the appearance of the machine.

In accordance with a second aspect of the invention, the filter arrangement includes a porous member extending between the outlet and container, the arrangement being such that a debris-carrying fluid stream flowing from the outlet may diffuse through the porous member and out of the opening, while the debris remains within the container, the porous member being spaced from the wall of the container so that air may diffuse through the wall of the porous member and pass upwardly through the space or spaces between the porous member and container, which space or spaces extend over a substantial part of the height of the porous member.

In accordance with a third aspect of the invention, the filter arrangement comprises a porous member extending between the outlet and container, the arrangement being such that a debris-carrying fluid stream flowing from the outlet may diffuse through the porous member and out of the opening, while the debris remains within the container, and wherein at least one gap is maintained between the porous member and the container to facilitate air flow through a major portion of the porous member, said gap extending at least into a lower part of the container when there is little or no debris in the container.

In accordance with a fourth aspect of the invention, the filter arrangement comprises a porous member extending between the outlet and container, the arrangement being such that a debris-carrying fluid stream flowing from the outlet may diffuse through the porous member and out of the opening, while the debris remains within the container, and wherein there is a gap for the passage of air filtering through the porous member, between the porous member and container, said gap extending into the container over a major part of the depth of the container side wall.

In accordance with a fifth aspect of the invention, the filter arrangement comprises a porous member extending between the outlet and container, the arrangement being such that a debris-carrying fluid stream flowing from the outlet may diffuse through the porous member and out of the opening, while the debris remains within the container, and wherein the fluid stream, where it exits from the outlet, is substantially rectilinear and non-helical, and flows generally towards the base of the container.

In accordance with a sixth aspect of the invention, we provide a suction sweeping machine including a suction head, a fan connected by a duct to the suction head, and an outlet duct from the fan for a fluid stream which may contain debris picked up by the suction head the outlet duct having a rearwardly extending generally horizontal portion and downstream thereof, a generally vertical portion terminating in an outlet which faces downwardly, there being a smooth transition from the generally horizontal to the generally vertical portion, and including a filter arrangement downstream of the outlet, said filter arrangement comprising a container for collecting debris and having an opening in an upper portion thereof; and a porous member extending between the outlet and container, the arrangement being such that debris in the fluid stream flowing from the outlet is collected within the porous member but fluid in the fluid stream may diffuse through the porous member and out of the opening, wherein the porous member extends from the outlet down into the container whereby the debris remains within the container when the porous member is removed from the container.

In accordance with a seventh and preferred embodiment of the invention, we provide a suction sweeping machine including a motor, a fan driven by the motor, a suction head connected by an inlet duct to the fan, whereby debris may be collected from the ground in a fluid stream generated by the fan, and be forced by the fan into an outlet duct extending from the fan to a container, wherein the outlet duct terminates in an outlet communicating with the container, there being a porous filter member extending from the outlet into the container through an opening in an upper portion thereof; whereby debris from the fluid stream in the outlet duct is collected within the porous member whereas the fluid in the fluid stream flowing from the outlet may diffuse through the porous member and out of the opening, and wherein an access opening is provided in a side wall of the container, through which debris within the porous member may be removed.

Preferably the porous member is a flexible tube, the lower end of which is located within the bottom of the container, and the upper end of which is in communication with said outlet. Preferably said flexible tube is supported at its upper end on a rigid support which is removably located within said container through said access opening in the side wall thereof, the rigid support being shaped to match the shape of said outlet.

Preferably the rigid support and the outlet are located relative to the opening in the container centrally towards the front thereof, so that spaces are left between the walls of the container and porous member over the whole areas of two side faces of the container for the passage of air from said fluid stream.

In the preferred embodiment the container comprises a generally rectangular compartment at the rear of the machine, and towards one side thereof, said compartment being defined by generally rigid mesh screens on the side thereof opposite said one side and to the rear thereof, by a generally impervious front wall, and by a generally impervious floor and roof walls, and by a door providing said access opening. One or more trays for collecting liquid and/or dust may be located in the bottom of the compartment. Preferably, also the sides of the compartment defined by said mesh screens are further defined by filter means which may comprise fine screens of textile material.

Also in the preferred embodiment, the fine screens preferably comprise a plurality of vertically extending candle filters, the candle filters comprising felt like socks each supported on a skeletal frame, and open at its upper end, the open upper end communicating with an overall machine casing which directs filtered air forwardly and downwardly.

As in all the embodiments a flexible plastic sack is preferably located within said container, which is preferably supported at its upper end on a rectangular frame, the dimensions of which correspond generally with the cross sectional shape of the container. It is preferred that the frame is slidably relative to a framework connected to a chassis supporting the outlet, between a position of use generally surrounding the outlet, and a sack replacement position achievable only when said access opening is open. Preferably clamping means is provided for clamping said frame in its position of use, in which upper end portions of the sack will also be held in engagement with the frame.

Preferably, the rigid support and frame are provided with co-operating support means whereby the rigid support may be removably supported in a predetermined location on said frame, so that when said frame is in its position of use, the porous member is in fluid communication with said outlet.

Preferably also, the filter arrangement includes a second filter member, through which the fluid stream flows after exiting the container, to remove fines from the fluid stream which do not remain in the container. In the majority of applications most of the finer dirt and dust will still tend to collect in the container such that replacement or cleaning of the filter arrangement, e.g. filter tube will only be required relatively infrequently. Alternatively or additionally, the filter arrangement may form a wall of an enclosure in which the container is located or an end wall of a conduit, and may be adapted for periodic replacement or cleaning. Most preferably, the container is replaceable without disturbing the filter arrangement.

Preferably also, the tubular porous member extends to the base of the container. Most preferably, the porous member and the container are arranged such that a gap is maintained therebetween, to facilitate airflow through a large area of the porous member. Most preferably, the porous member is frustoconical or flared, and widens from the outlet towards the base of the container.

The porous member is preferably formed of flexible material, for example woven polypropylene, but it may be rigid, and formed for example of a metal mesh. A single porous member may be provided. Alternatively, two or more porous members, of successively finer pore size, may be provided such that larger debris is retained in the container by the first porous member, while finer particles are retained by the succeeding members. In a suction sweeping machine, such an arrangement may obviate the need for an outer bag or a second filter member.

This and other aspects of the present invention will now be described, by way of example, with reference to the accompanying drawings, in which.

Figure 1:
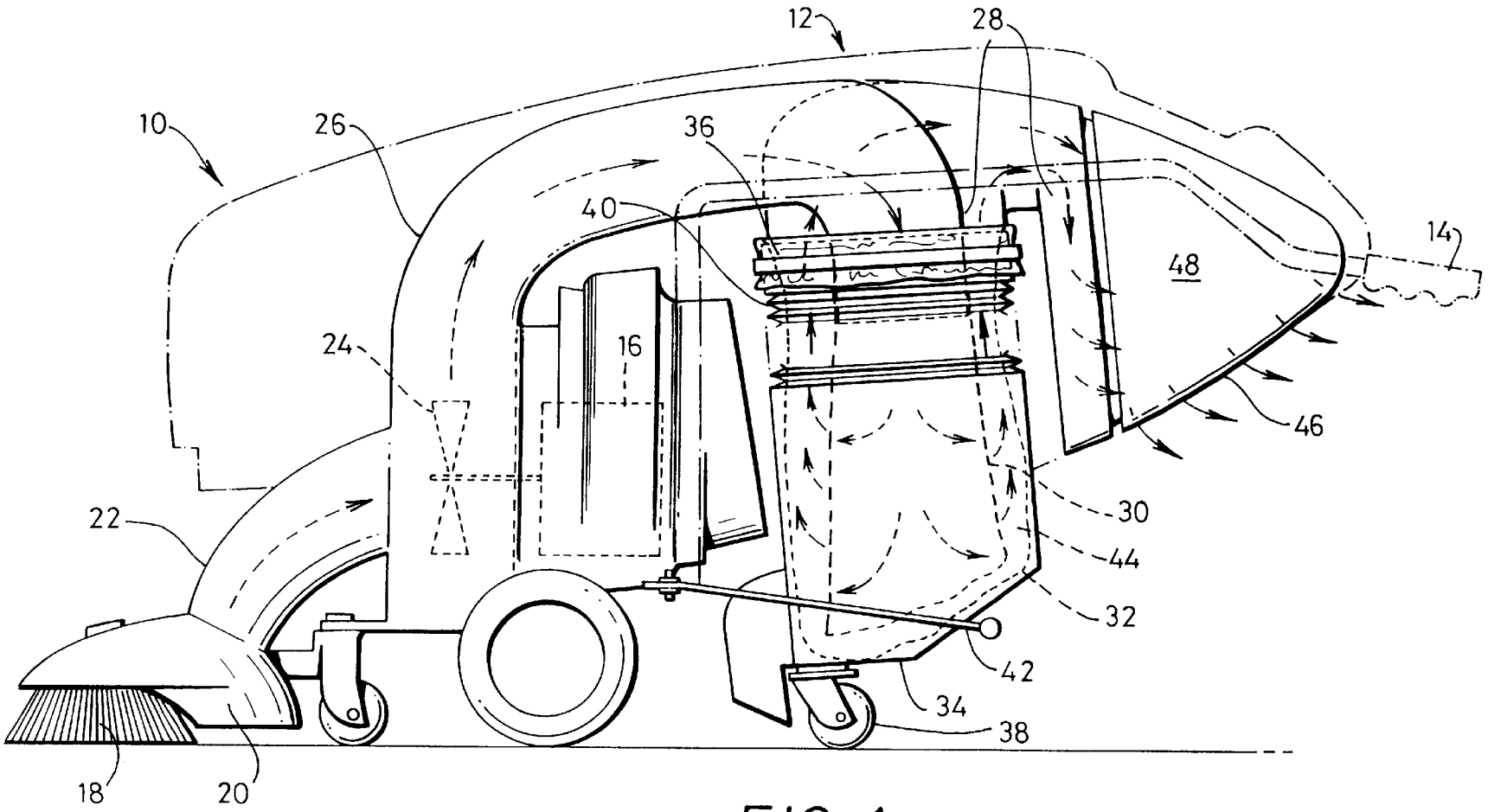
FIG. 1 is a somewhat schematic side view of a suction sweeping machine provided with a filter arrangement in accordance with a first embodiment of the present invention.

Reference is first made to FIG. 1 of the drawings which illustrates a suction sweeping machine 10 including a filter arrangement 12 in accordance with one embodiment of the present invention. The machine 10 is wheel mounted and is operable by a person walking behind the machine and directing the machine by means of handles 14. Power for the machine is provided by a small IC engine 16 which also drives a pair of side brushes 18 to direct dirt, dust and debris into a vacuum intake 20. A conduit 22 leads from the intake 20 to an impeller or fan 24 which, in addition to drawing the air through the intake 20, breaks up any larger debris carried into the machine. From the impeller 24, the debris-carrying airstream is directed through an upwardly, then rearwardly and then downwardly extending conduit 26, the outlet 28 of which leads into the filter arrangement 12. There is a smooth transition of the conduit where it changes from a horizontal to a generally downwardly extending orientation immediately upstream of the outlet 28, so that at the outlet 28, there is a generally rectilinear non helical flow of the airstream.

In communication with the outlet 28 is a porous member in the form of a conical porous tube 30 which extends downwardly into a container in the form of a disposable plastic bag 32. Both the tube 30 and the bag 32 are located within a collection box 34 which is secured to the machine by a clamp arrangement 36. The upper end of the bag 32 is folded over the top of the box 34 and is also held in place by the clamp arrangement 36. A supporting caster 38 is mounted on the base of the box 34 and some movement of the box relative to the rest of the machine 10 is permitted by a flexible bellows section 40 which forms the upper part of the box 34 and by a pair of pivotable links 42 which secure the lower end of the box relative to the machine 10.

Within the box 34, the tube 30 and plastic bag 32 are arranged such that an annular gap 44 is maintained between the tube 30 and bag 32. Thus, air may flow downwardly into the tube 30, change direction and dissipate through the tube wall into the gap 44, and then flow out of the open end of the bag 32 through an annular space around the outlet 28. The majority of dust, dirt and debris carried by the incoming airstream does not pass through the wall of the tube 30 and will therefore gather in the lower end of the tube 30 within the bag 32. Any remaining fines carried by the airstream are trapped by a filter member 46 provided in a filter box 48 at the rear of the machine.

If the machine 10 is provided with water mist dust suppression the water droplets will also be collected within the tube 30 and thus within the bag 32.

Once the tube 30 is filled with debris, the operator simply releases the clamp 36, tilts the box 34 to the side, pulls the tube 30 out of the bag 32, and then lifts the bag 32 from the collection box 34. The bag 32 may then be tied and left for collection and disposal. A new bag is then placed in the box 34, the upper end of the bag folded over the top of the box 34, the tube 30 placed in the bag 32 and the box and bag 34, 32 secured to the machine with the clamp 36.

As the majority of dust and dirt picked up by the machine 10 does not pass through the wall of the filter tube 30, the filter member 46 is likely to require only infrequent replacement or cleaning, typically on a daily basis.

Figure 2:
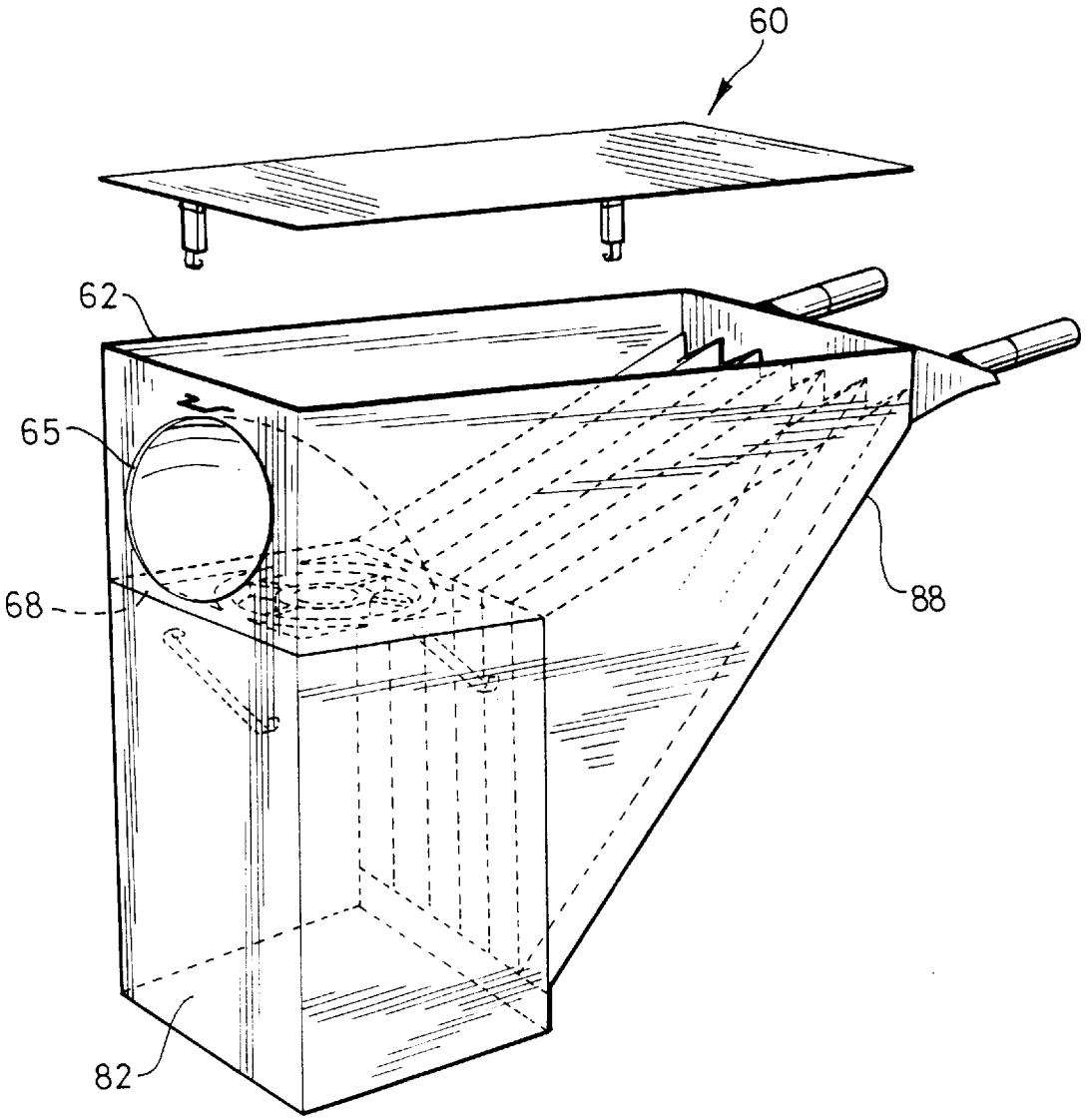
FIG. 2 is a perspective view of the filter arrangement of a suction sweeping machine in accordance with a further embodiment of the present invention.
Figure 3:
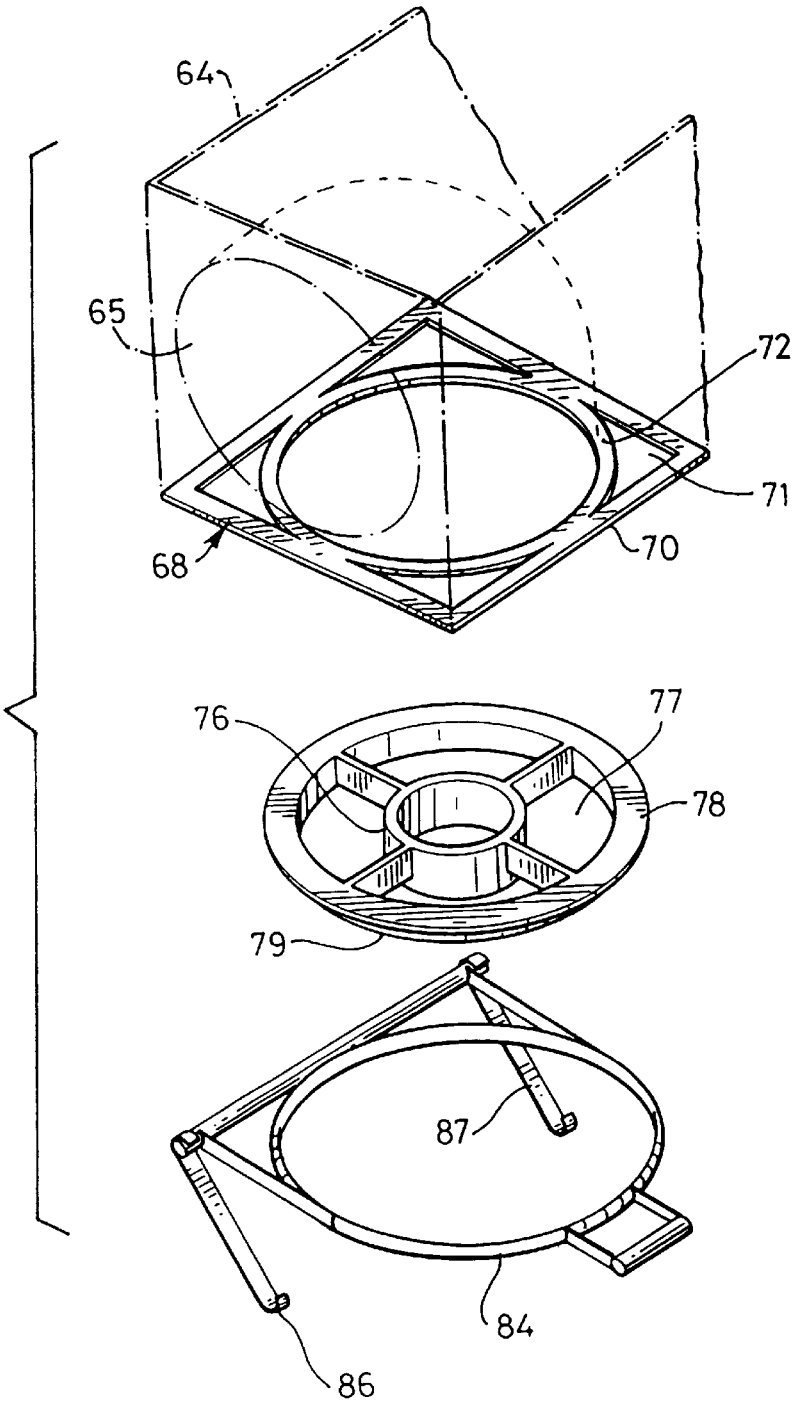
FIG. 3 is a perspective view of part of the filter arrangement of FIG. 2.
Figure 4:
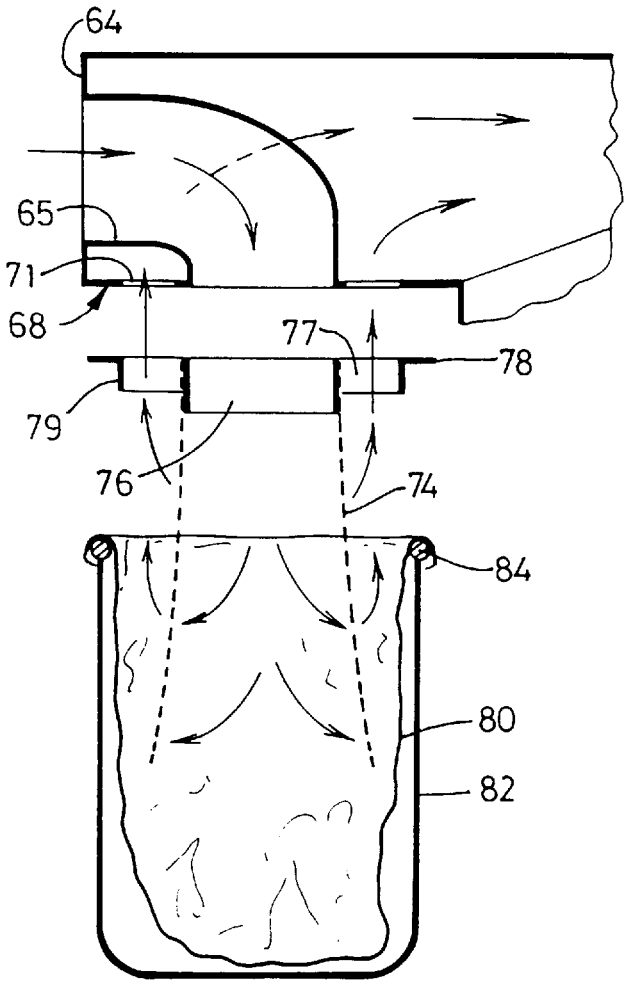
FIG. 4 is a sectional side view of the parts of FIG. 3.

Reference is now made to FIGS. 2, 3 and 4 of the drawings which illustrate a filter arrangement 60 in accordance with a further embodiment of the present invention, also for use in a suction sweeping machine as described above. The filter arrangement 60 is provided within a housing 62 for location at the rear of the suction sweeper machine and includes an upper portion 64 containing a conduit 65 which smoothly changes direction through a right angle from horizontal to vertical. The conduit communicates with the outlet of the duct leading from the impeller or fan 24 of the machine. Each end of the conduit 65 terminates at a diaphragm panel 68. At its downstream end the panel 68 includes a square peripheral frame 70 and a central circular frame portion 72 which engages the end of the conduit 65. A porous sock 74 is mounted on the inner portion 76 of a circular frame 78 provided below the panel 68 and forms a continuation of the conduit 65. The frame 78 is mounted to the diaphragm panel 68 and a seal is formed between the outer edges of the frame and panel 8, 68. The sock 74 extends into a plastic sack 80, preferably to adjacent the base thereof, which is itself located within a rectangular box 82. The sack 80 is supported by a sack carrier frame 84, the top of the sack 80 being folded over the frame 84 and held on the frame 84 by the circular frame 78, which includes a circumferential wall 79 sized to provide a friction fit with the sack carrier frame 84 and thus clamp the sack 80 on the frame 84. The frame 84 is mounted on a pair of guides 86, 87.

In a similar manner to the above described embodiment of FIG. 1, a debris-carrying airstream passes through the conduit 65 and downwardly into the open end of the sock 74, the air then dissipating through the sock leaving the debris trapped inside. This dissipating air then moves upwardly in the gap between the sock and bag 80, then upwardly through annular spaces 77 between the inner frame portion 76 and the circular peripheral frame 78 and through spaces 71 in the panel 68 into the upper portion 64 of the housing. The air exits the housing through a large area filter member 88.

As with the first described embodiment, a filled plastic sack 80 may be easily removed from the housing 62 and replaced with an empty sack, the filter member 88 requiring replacement or cleaning substantially less frequently.

Figure 5:
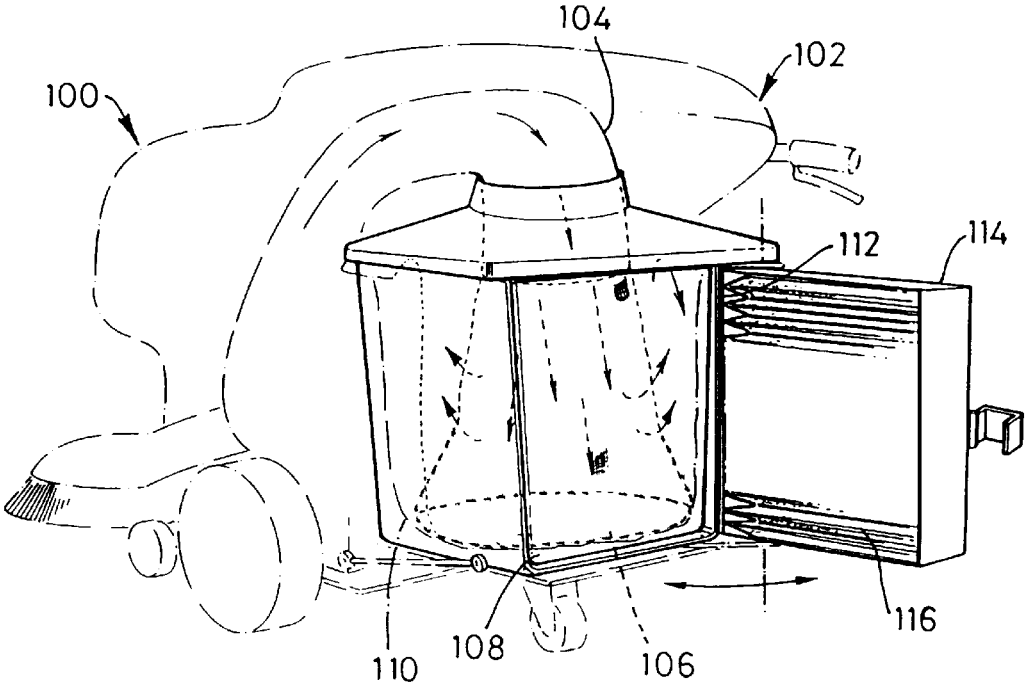
FIG. 5 is a cut-away perspective view from the rear of a suction sweeping machine including a filter arrangement in accordance with another embodiment of the present invention.
Figure 6:
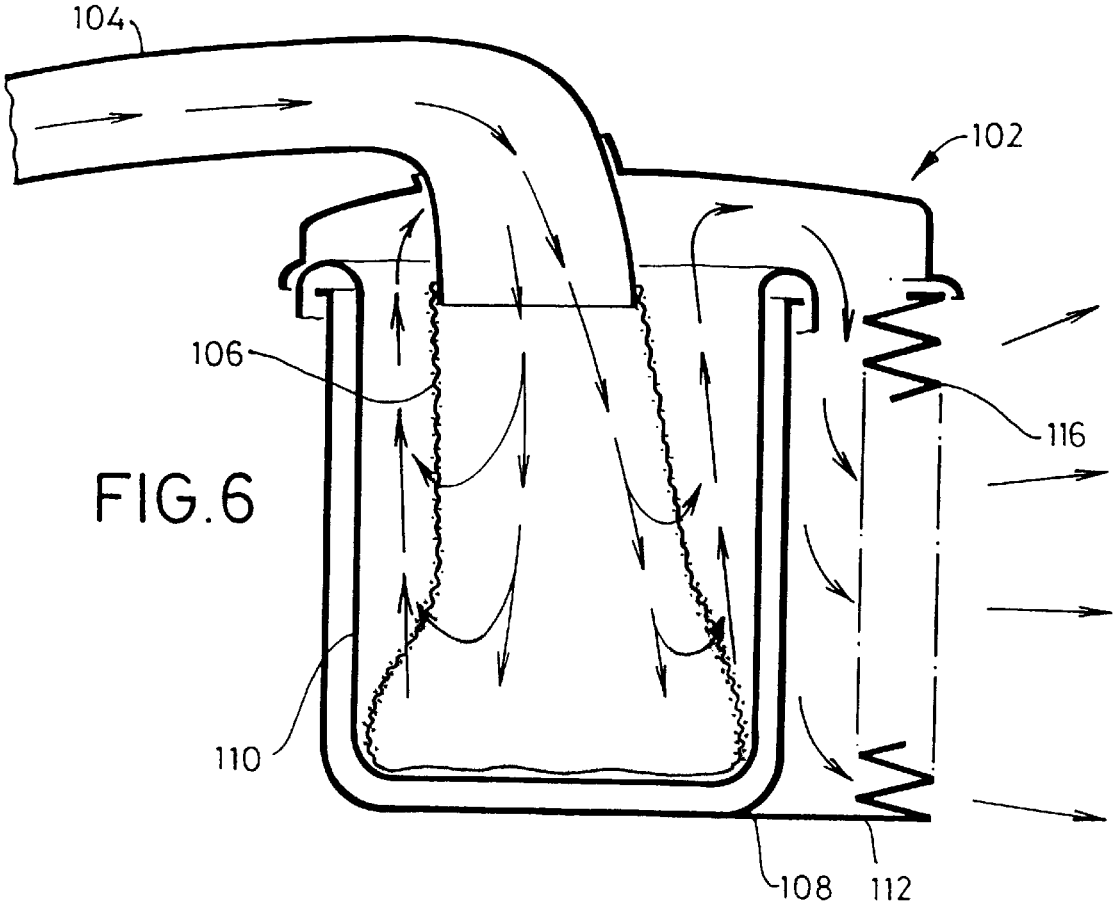
FIG. 6 is a somewhat schematic sectional side view of the filter arrangement of FIG. 5.

Reference is now made to FIGS. 5 and 6 of the drawings which illustrate a slightly different suction sweeping machine 100 provided with a slightly different filter arrangement 102. As in the previously described embodiments, debris-carrying air is blown from a conduit or duct 104 downwardly into a conical porous open-ended sock 106 located in a rear portion of the machine 100. The sock 106 extends fully into an open-topped rectangular container 108 lined with a plastic bag 110. The container 108 sits in a housing 112, access to which is gained through a rear door 114 provided with a filter 116.

In use, the larger debris in the airstream exiting the duct 104 is trapped inside the sock 106, the filtered air passing through the sock 106, up the gap between sock 106 and bag 110 out of the container 108 and then through the filter 116, where any remaining dust or dirt in the airstream is trapped. When the sock 106 has become filled with debris, the machine is switched off and the door 114 opened, such that the container 108 may be removed from the housing 112. As the container 108 is removed the debris falls from the sock 106 into the container 108 and the debris filed bag 110 is then lifted from the container 108 for disposal.

Another bag may be located in the container 108, which is then repositioned in the housing 112, with the sock extending into the container 108, and the door 114 closed.

Referring now to the embodiment of FIGS. 7–12, in the suction sweeping machine shown therein, those parts which are the same as, or similar to the parts of the machine shown in FIG. 1 are identified by the same reference numerals. However, the machine has a completely different filter arrangement, as is apparent from FIGS. 7–12.

As in the previous embodiments, the duct outlet 28 is oriented so as to direct the fluid stream containing debris downwardly into a container, provided by a plastic bag or refuse sack 32. The outlet 28 is rectangular as shown in FIGS. 9 and 10, and terminates in the top of a compartment for the container, which is generally rectangular, and defined by an impervious front wall 120, a side wall and a rear wall (not shown) each defined by a rigid mesh filter 122, a side door 124, a generally waterproof floor 126 in the form of a rectangular tray to the upstanding rim of which the three side walls are connected, and a roof 128.

Figure 10:
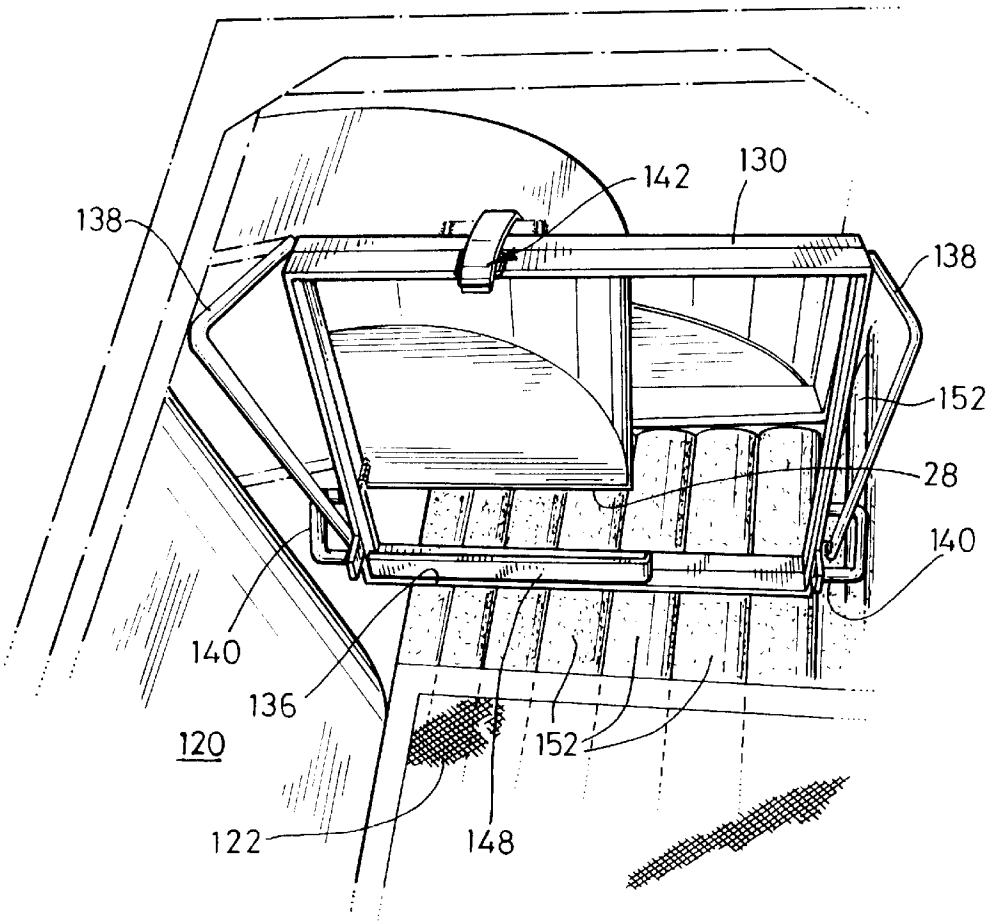
FIG. 10 is another perspective view, similar to FIG. 9, but with the frame in a position of use.
Figure 8:
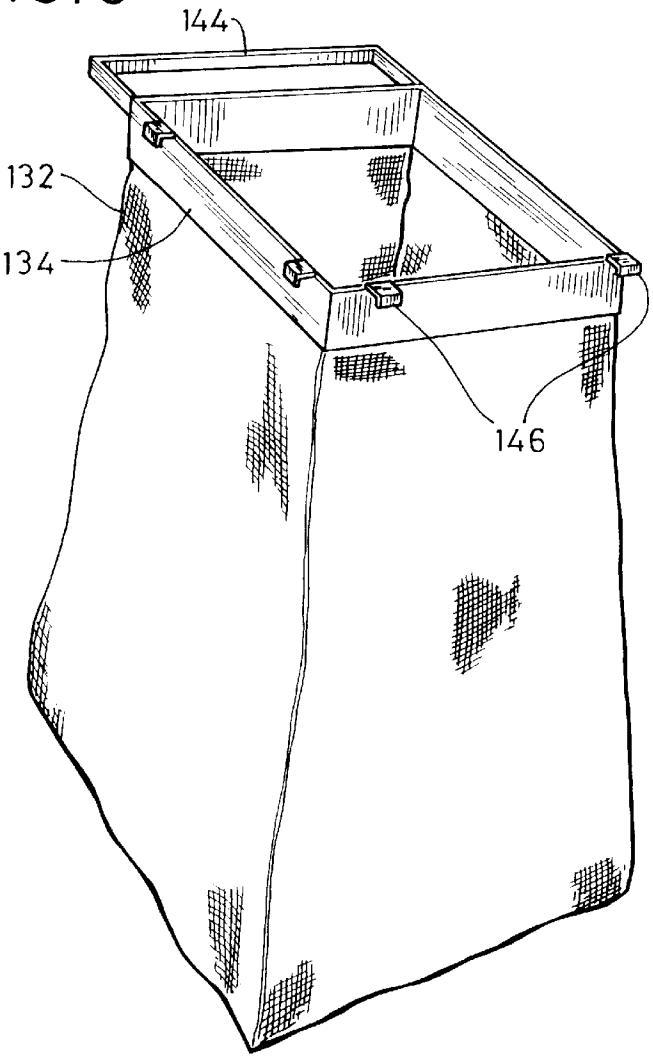
FIG. 8 is a perspective view from above of a flexible porous member for location within the interior of the machine of FIG. 7.

The outlet 28 is supported by a rectangular framework 130 of the same general dimension as the compartment, the framework 130 being supported by the machine chassis, with the outlet being located generally centrally of the front wall 120 (see FIG. 10). The container is located laterally offset on the machine, to the side defined by the door 124.

The filter arrangement for the fluid stream containing debris exiting from the outlet 28 includes a flexible porous tube or sleeve 132, which is supported at one end on a rigid rectangular support 134 (see FIGS. 8 and 11) of the same dimension as the outlet 28. The sleeve 132 tapers and is larger at its base than where it is connected to the support 134, and its length is such that, in use, it will, with its support 134, extend from the outlet 28 almost to the floor 126.

Figure 9:
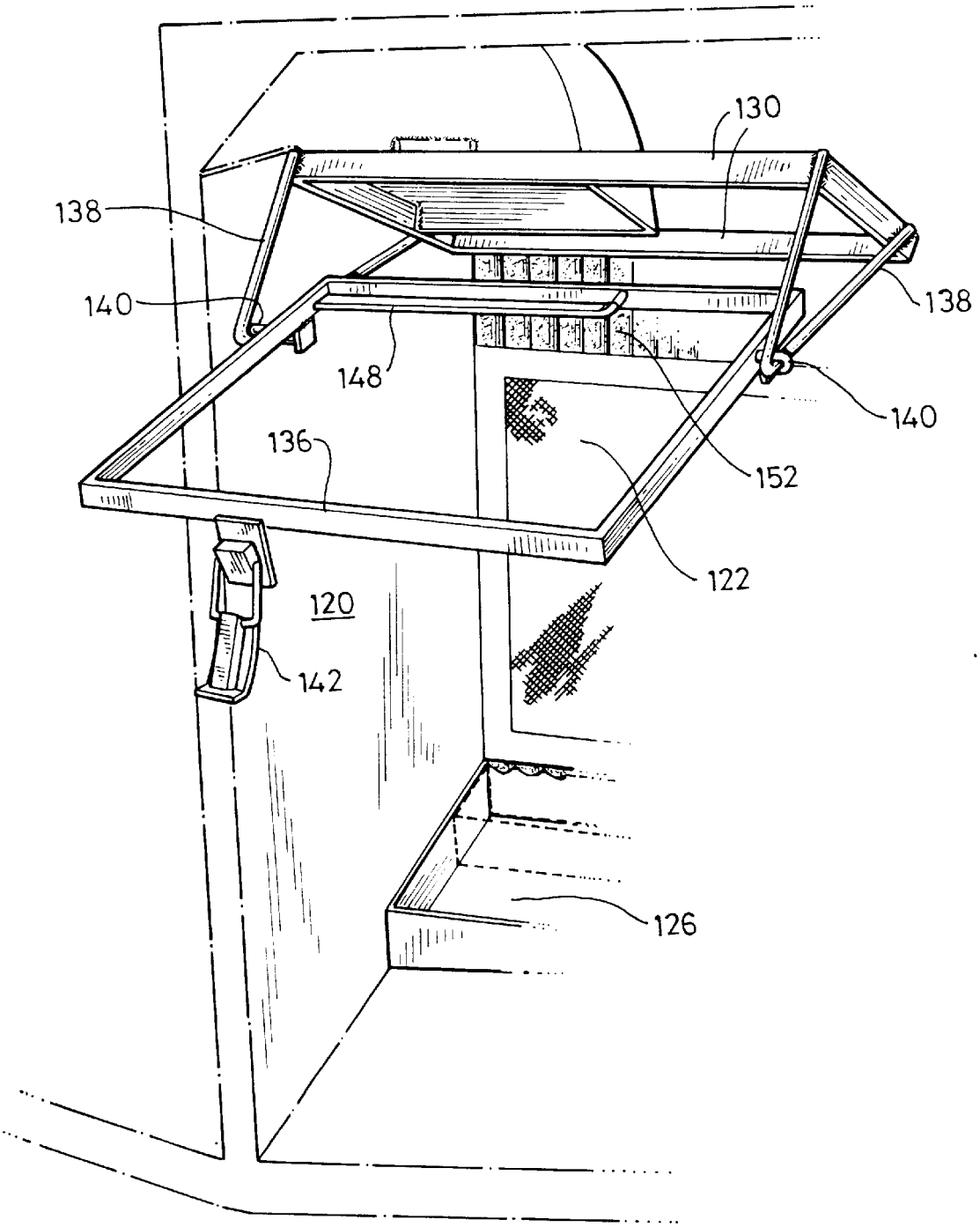
FIG. 9 is a perspective view of the interior of part of the machine, showing an outlet for a fluid stream containing debris, and a rectangular frame and supporting slideway therefor, the frame being in a sack replacement position, but without a porous member or sack in position.

Prior to using the sweeping machine, a plastics sack 32 is located within the compartment by wrapping its upper edge region over a rectangular frame 136 which is slidably supported on two inclined slideways 138 supported from the framework 130, as shown in FIGS. 9, 10 by stirrups 140. FIG. 9 shows the frame slid out of the open side doorway of the machine, ready to receive a sack 32 whereas FIG. 10 shows the frame in a position of use (but without a sack fitted thereto), and held in that position by a latch 142.

Figure 11:
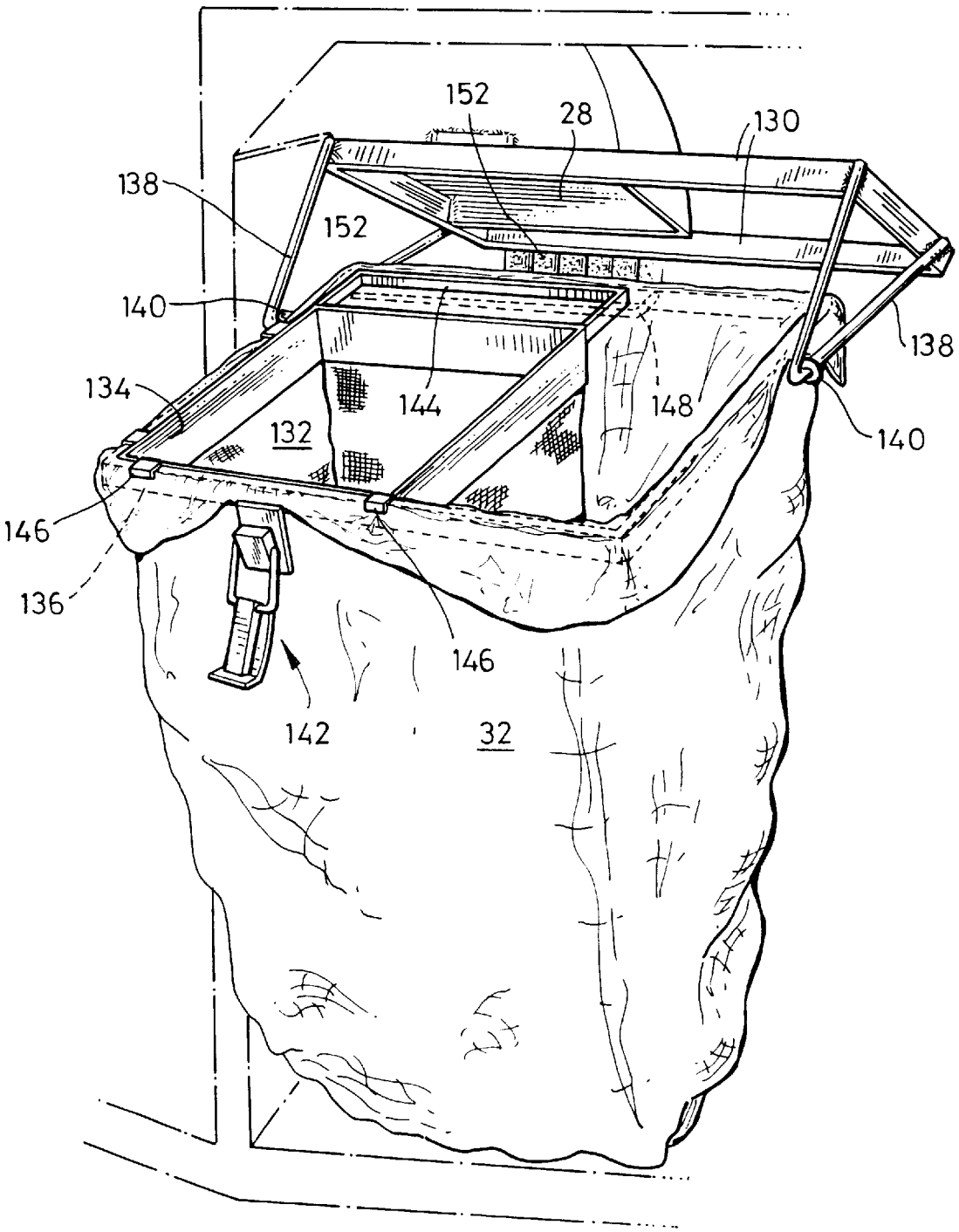
FIG. 11 is a view similar to FIG. 9, but with the porous member and sack fitted.
Figure 12:
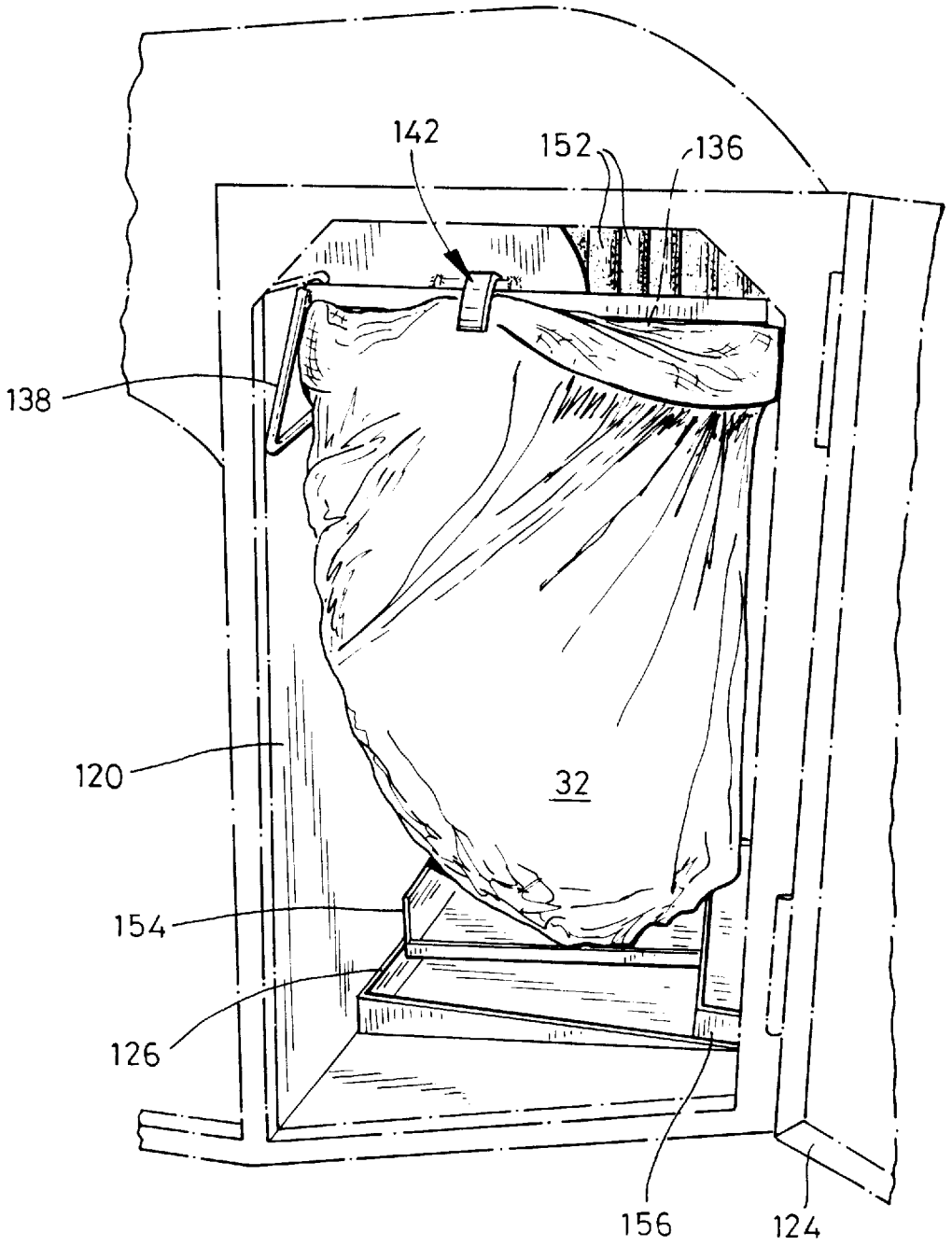
FIG. 12 is another perspective view, similar to FIG. 10, but with the porous member and sack fitted.

FIGS. 11 and 12 show a sack 32 supported on the frame 136; the support 134 of the sleeve 132 is provided with a U-shaped support bracket 144 at its rear, and with two support hooks 146 at its front, the former being designed to rest on a support ledge 148 formed on the frame 136, at its 'rear' and the latter to hook over a 'front' member of the frame 136. As can be seen from FIG. 11, the presence of the support 134 on the frame 136 is designed to hold an upper edge region of the sack 32 in position on the frame 136. When the latter has been slid back into its position of use, and latched in that position by the latch 142, as seen in FIG. 12, the whole of the upper edge region of the sack 32 will be clamped to the frame 136, and the sleeve support 134 will be held up in communication with the outlet 28.

Once the door 124 has been closed, the sweeping machine is ready to use. In use, the debris laden fluid stream will exit into the sack 32 as in the other embodiments, and the air therefrom will diffuse through the porous sleeve 132, leaving the majority of the debris in the sack. This air will move upwardly in the two gaps between the side and rear walls of the sack and sleeve respectively; these gaps are readily apparent in FIG. 11. This air, which may contain light and/or fine debris, will then pass through the spaces between the outlet 28 and framework 130 (see FIG. 10), into the general area of the compartment defined exteriorly by the mesh screens 122 and the door 124, and interiorly by the sack 32. To keep the sack spaced from the door, a U-shaped plate 150 is secured to the inner face of the door. This air is then filtered again by rows of candle filters 152 located to the rear of the compartment and on the side thereof remote from the door 124.

Figure 7:
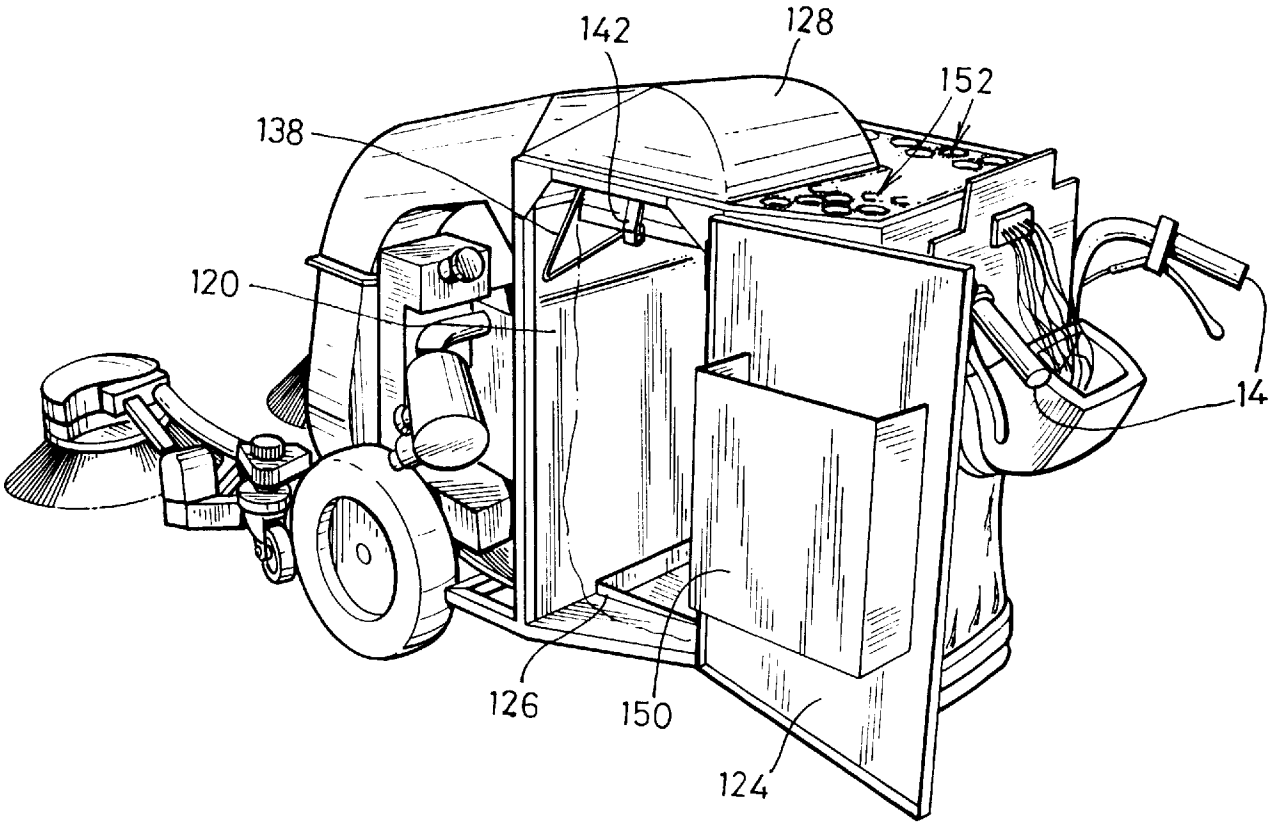
FIG. 7 is a perspective view, from one side and to the rear, of a fourth embodiment of the present invention, with part of the overall machine casing removed, and with a side access door open, with various parts from within the machine removed to show the interior thereof.

Candle filters are known per se, and comprise slim tubular socks made of felt or the like, supported on skeletal frames, such as helically coiled wire 'springs'. The candle filters 152 are open at their upper ends as shown in FIG. 7, and are supported at their upper ends in an apertured plate, and the air under pressure in the compartment is forced by the fan 24 through the felt, which screens out fine debris, dust and other particles, and then escapes through the open top of the candle filters.

There is an overall casing (not shown) for the sweeping machine, into the interior of which this filtered air escapes. This casing is designed to direct the air forwardly and downwardly for discharge into the surrounding atmosphere.

Beneath each of the rows of candle filters 152 there is a removable tray 154, 156 for collecting dust collected on the exterior of the filters 152. This dust can periodically be shaken off the felt material with the aid of a shaker mechanism (for example, an electric motor and counterweight acting on a sub frame for the filters, the sub frame being spring mounted on the chassis of the machine).

A further tray (not shown) is located in the floor of the compartment for collecting liquids sucked up by the machine. This may be provided with a drain plug.

In the event of the machine being used in wet weather, the plastic sack has one or more drain holes formed therein to allow water continuously to drain out of the machine as it sweeps along. However, in fine weather, if there is little water on the surface being swept, water would be collected in a normal plastic sack and be absorbed by the debris therein. When it is raining, instead of using a plastic sack with holes therein, it is preferred to use a porous plastic bag which will allow the water to drain out of the bag and through the drain hole in the tray beneath it. When the machine is operated in wet weather it can soak up up to about 5 liters of water per minute quite easily. There is also a water door or sludge door (not shown) in the fan housing which should be opened in wet weather, but even when this is open the machine will still push water into the plastic bag or sack. If there are no holes in the sack or bag it can quickly fill up with water and is then almost completely impossible to handle. Accordingly, in wet weather a bag or sack from which water can drain must be used as the container and the water must also be allowed to exit through the tray in the compartment for the bag or sack. Of course, when it is raining it does not matter that water picked up by the machine is allowed to drain out through the bottom thereof since the trail of water is not visible.

It is preferred that the sweeping machine is provided with a water operated dust suppression system, and a water tank for this purpose is preferably located in a side door of an engine compartment of the machine, or as a "saddle" tank over an internal suction casing.

Preferably, the machine is fitted with a towing device, so that a wheeled seat can be drawn behind it for use by the operator. This seat may be collapsible and stowable beneath the rear of the machine when not required. Accordingly, the rear of the machine is designed to accommodate the collapsed wheeled seat. Part of the rear most portion of this machine may be supported on a horizontal pivot axis for this purpose.

All the controls for the machine are located on and/or between or in the vicinity of a pair of rearwardly extending handlebars 14. By providing a side access door for changing the sack 32, as distinct from a rear door, there is no need to articulate the handle bars before opening the door. To replace a sack, the machine is stopped, the door 124 is opened, and the frame 136 for the sack 32 is unlatched from the framework 130, so that the frame 136, together with the sack 32 and the support 134 carrying the flexible porous sleeve 132 can be slid to the FIG. 11 position. The support 134 and attached sleeve 132 are then lifted off the frame 136 and out of the sack 32, allowing all the debris in the sack to fall to the bottom thereof. This filled sack 32 can then be lifted out of its frame 136, disposed of, and be replaced with a fresh empty sack 32.

It will be apparent to those of skill in the art that the above-described embodiments of the present invention obviate the need for a porous internal bag and also allow replacement of the internal bag or sack without disturbing the filter member.

It will also be apparent to those of skill in the art that the above-described embodiments are merely exemplary of the present invention and that various modifications and improvements may be made thereto without departing from the scope of the invention; for example, various component parts of a particular embodiment of sweeping machine described above can be used in one of the other described embodiments of machine, in place of, or in conjunction with, component part(s) thereof, as appropriate.

I claim:

1. A suction sweeping machine for picking up debris in an air stream generated by a fan, and directed through said machine to an outlet, comprising:

a container for collecting debris and having an opening in an upper portion thereof, an open ended flexible porous tube extending from the outlet, through the container opening and to the base of the container, such that the debris-carrying air stream flowing from the outlet diffuses through the porous tube and out of the opening, while the debris remains within the container.

2. A suction sweeping machine for picking up debris in an air stream generated by a fan, and directed through said machine to an outlet, comprising a container for collecting debris having an opening in an upper portion thereof, a flexible porous member extending from the outlet into the interior of the container such that a debris-carrying air stream flowing from the outlet diffuses through the porous member and out of the opening, while the debris remains within the container, the porous member being spaced from the wall of the container so that air diffuses through the wall of the porous member and passes upwardly through any space between the porous member and container, which space extends over a substantial part of the porous member.

3. A suction sweeping machine for picking up debris in an air stream generated by a fan, and directed through said machine to an outlet, comprising a container for collecting debris and having an opening in an upper portion thereof, a flexible porous member extending from the outlet into the interior of the container such that a debris-carrying air stream flowing from the outlet diffuses through the porous member and out of the opening, while the debris remains within the container, and wherein at least one gap is maintained between the porous member and the container to facilitate air flow through a major portion of the porous member, said gap extending at least into a lower part of the container when there is little or no debris in the container.

4. A suction sweeping machine for picking up debris in an air stream generated by a fan, and directed through said machine to an outlet, comprising a container for collecting debris having an opening in an upper portion thereof, a flexible porous member extending from the outlet into the interior of the container such that a debris-carrying fluid stream flowing from the outlet diffuses through the porous member and out of the opening, while the debris remains within the container, and wherein there is a gap for the passage of air filtering through the porous member, between the porous member and container, said gap extending into the container over a major part of the container side wall.

5. A suction sweeping machine for picking up debris collected by a brush in an air stream generated by a fan, and directed through said machine to an outlet, comprising a container for collecting debris having an opening in an upper portion thereof, a flexible porous member extending from the outlet into the interior of the container such that a debris-carrying air steam flowing from the outlet diffuses through the porous member and out of the opening, while the debris remains within the container, and wherein the fluid stream, where it exits from the outlet, is substantially rectilinear, and flows generally towards the base of the container.

6. A suction sweeping machine including a suction head, a fan connected by an inlet duct to the suction head, and an outlet duct from the fan for a fluid stream which may contain debris picked up by the suction head, the outlet duct having a rearwardly extending generally horizontal portion and downstream thereof, a generally vertical portion terminating in an outlet which faces downwardly, there being a smooth transition from the generally horizontal to the generally vertical portion, and including a filter arrangement downstream of the outlet, said filter arrangement comprising a container for collecting debris and having an opening in an upper portion thereof, and a porous member extending between the outlet and container and down into the interior of the container such that debris in the fluid stream flowing from the outlet is collected within the porous member but fluid in the fluid stream diffuses through the flexible porous member and out of the opening, whereby the debris remains within the container when the porous member is removed from the container.

7. A suction sweeping machine including a motor, a fan driven by the motor, a suction head connected by an inlet duct to the fan, whereby debris may be collected from the ground in a fluid stream generated by the fan, and be forced by the fan into an outlet duct extending from the fan to a container, wherein the outlet duct terminates in an outlet communicating with a compartment within which the container is located, there being a porous filter member extending from the outlet into the container through an opening in an upper portion thereof, whereby debris from the fluid stream in the outlet duct is collected within the container whereas the fluid in the fluid stream flowing from the outlet diffuses through the porous member and out of the opening, and wherein an access opening is provided in a side wall of the compartment, through which debris within the container may be removed.

8. A suction sweeping machine according to claim 7 wherein the porous member is a flexible tube, the lower end of which is located within the bottom of the container, and the upper end of which is in communication with said outlet.

9. A suction sweeping machine according to claim 8, wherein said flexible tube is supported at its upper end on a rigid support which is removably located within said container through said access opening in the side wall thereof, the rigid support being shaped to match the shape of said outlet.

10. A suction sweeping machine according to claim 9 wherein the rigid support and the outlet are located relative to the opening in the container centrally adjacent a front thereof, so that spaces are left between the walls of the container and porous member over the whole areas of two side faces of the container for the passage of air from said fluid stream.

11. A suction sweeping machine according to claim 7 wherein the compartment in which a container is located is a generally rectangular compartment at the rear of the machine, and towards one side thereof, said compartment being defined by generally rigid mesh screens on the side thereof opposite said one side and to the rear thereof, by a generally impervious front wall, and generally impervious top and bottom walls, and by a door providing said access opening.

12. A suction sweeping machine according to claim 11, wherein at least one tray is located in the bottom of the compartment.

13. A suction sweeping machine according to claim 12 wherein the sides of the compartment defined by said mesh screen are further defined by filter means.

14. A suction sweeping machine according to claim 13 wherein said filter means comprise fine screens of textile material.

15. A suction sweeping machine according to claim 13 wherein said filter means comprise a plurality of vertically extending candle filters, each of said candle filters comprising a felt-like sock supported on a skeletal frame, and open at its upper end, the open upper end communicating with an overall machine casing which directs filtered air forwardly and downwardly.

16. A suction sweeping machine according to claim 7 wherein the container is a flexible plastic sack located within said compartment.

17. A suction sweeping machine according to claim 16 wherein the sack is supported at its upper end on a rigid rectangular frame, the dimensions of which correspond generally with the cross sectional shape of the compartment.

18. A suction sweeping machine according to claim 17 wherein the frame is slidable relative to a framework supporting the outlet, between a position of use generally surrounding the outlet, and a sack replacement position achievable only when said access opening is open.

19. A suction sweeping machine according to claim 18 including clamping means for clamping said frame in its position of use, in which upper end portions of the sack will also be held in engagement with the frame.

20. A suction sweeping machine according to claim 19 wherein said porous member is a flexible tube suppoted on a rigid rectangular support shaped to match the shape of the outlet, said support being removably locatable on said frame whereby upper end portions of the sack will be held in engagement with the frame.

21. A suction sweeping machine according to claim 20 wherein said rigid support and said frame are provided with cooperating support means whereby the rigid support may be removably supported in a predetermined location on said frame, so that when said frame is in its position of use, the porous member is in fluid communication with said outlet.

22. A suction sweeping machine according to claim 7 including a second filter member, through which the fluid stream flows after exiting the container.

23. A suction sweeping machine according to claim 22 wherein the second filter member forms a wall of an enclosure in which the container is located.

24. A suction sweeping machine according to claim 23 wherein the container comprises a plastic sack which is replaceable without disturbing the second filter member.

25. A suction sweeping machine according to claim 1 wherein the tubular porous member is open at an end thereby which is spaced from the outlet.

26. A suction sweeping machine according to claim 5 wherein the tubular porous member extends to the base of the container.

27. A suction sweeping machine according to claim 1 wherein the porous member and the container are arranged such that a gap is maintained therebetween, to facilitate airflow through a large area of the member.

28. A suction sweeping machine according to claim 7 wherein the porous member is flared, and widens from the outlet towards the base of the container.

29. A suction sweeping machine according to claim 1 wherein the container is located in a generally rectangular compartment at the rear of the machine.

30. A suction sweeping machine according to claim 29 wherein said compartment is defined partly by generally rigid mesh screens at a rear end thereof.

31. A suction sweeping machine according to claim 29 wherein the compartment is supported on a castor and wherein the base of the compartment is capable of some movement relative to the rest of the machine.

32. A suction sweeping machine according to claim 1 including a second filter member, through which the fluid stream flows after exiting the container.

33. A suction sweeping machine according to claim 32 wherein the second filter member forms a wall of an enclosure in which the container is located.

* * * * *